US007228858B2

(12) United States Patent
Baker

(10) Patent No.: US 7,228,858 B2
(45) Date of Patent: Jun. 12, 2007

(54) PROTECTIVE GARMENT

(76) Inventor: Stephen G. Baker, 7861 Langlo Ranch Rd., Goleta, CA (US) 93117

( * ) Notice: Subject to any disclaimer, the term of this patent is extended or adjusted under 35 U.S.C. 154(b) by 0 days.

(21) Appl. No.: 11/076,641

(22) Filed: Mar. 9, 2005

(65) Prior Publication Data

US 2007/0051370 A1 Mar. 8, 2007

(51) Int. Cl.

| | |
|---|---|
| ***A62B 17/04*** | (2006.01) |
| ***A62B 9/02*** | (2006.01) |
| ***A62B 7/10*** | (2006.01) |
| ***A41D 13/00*** | (2006.01) |
| ***A42B 1/18*** | (2006.01) |

(52) U.S. Cl. ..... 128/201.22; 128/201.25; 128/205.25; 2/9; 2/206

(58) Field of Classification Search ..... 128/200.24, 128/201.22, 201.23, 201.24, 201.25, 201.29, 128/202.11, 205.25, 205.27, 205.28, 205.29, 128/206.12, 206.13, 206.19, 206.21, 206.27, 128/206.28, 207.11; 2/203–207, 9, 127, 2/123, 458, 468, 202

See application file for complete search history.

(56) References Cited

U.S. PATENT DOCUMENTS

| | | | | |
|---|---|---|---|---|
| 774,703 | A * | 11/1904 | Scott | 2/206 |
| 996,135 | A | 6/1911 | Poe | |
| 2,547,931 | A | 4/1951 | Grazia | |
| 3,516,404 | A | 6/1970 | Spross | |
| 4,019,508 | A | 4/1977 | Der Estephanian et al. | |
| 4,038,698 | A | 8/1977 | Smith | |
| 4,084,585 | A * | 4/1978 | Venaleck | 128/206.13 |
| 4,790,307 | A * | 12/1988 | Haber et al. | 128/206.19 |
| 4,864,654 | A | 9/1989 | Schriver et al. | |
| 4,944,041 | A | 7/1990 | Buenos et al. | |
| 5,033,115 | A * | 7/1991 | Bowling et al. | 2/51 |
| 5,431,156 | A | 7/1995 | Sundstrom | |
| 5,490,501 | A | 2/1996 | Crowley | |
| 5,628,308 | A * | 5/1997 | Harges et al. | 128/206.21 |
| 5,664,259 | A * | 9/1997 | Budd | 2/115 |
| 5,836,303 | A * | 11/1998 | Hurst et al. | 128/206.24 |
| 5,884,336 | A * | 3/1999 | Stout | 2/206 |
| 6,095,143 | A | 8/2000 | Dyrud et al. | |
| 6,338,340 | B1 * | 1/2002 | Finch et al. | 128/205.27 |
| 6,418,559 | B1 * | 7/2002 | Wrecsics et al. | 2/127 |
| 6,665,881 | B2 * | 12/2003 | Giggleman et al. | 2/202 |
| 6,775,850 | B1 | 8/2004 | Grilliot et al. | |
| 6,868,852 | B2 * | 3/2005 | Gaschke | 128/201.13 |
| 7,137,150 | B2 * | 11/2006 | Larson | 2/202 |
| 2004/0078860 | A1 * | 4/2004 | Bell et al. | 2/9 |
| 2005/0050612 | A1 * | 3/2005 | Larson | 2/203 |
| 2005/0060789 | A1 * | 3/2005 | Waldman | 2/205 |
| 2005/0120452 | A1 * | 6/2005 | Cominsky | 2/9 |
| 2006/0085881 | A1 * | 4/2006 | Gellis et al. | 2/9 |
| 2006/0143796 | A1 * | 7/2006 | Bugarin | 2/202 |

FOREIGN PATENT DOCUMENTS

WO WO 2004/033044 A1 4/2004

* cited by examiner

*Primary Examiner*—Teena Mitchell
(74) *Attorney, Agent, or Firm*—Cislo & Thomas LLP

(57) ABSTRACT

A protective garment incorporates a face and neck mask adapted to filter out airborne particulates. The protective garment outwardly has the appearance of a conventional shirt, sweater or jacket, yet incorporates a convenient, easy to use, and readily accessible mask that is always available to the wearer and is ready for use on short notice.

5 Claims, 3 Drawing Sheets

PROTECTIVE GARMENT

BACKGROUND OF THE INVENTION

1. Field of the Invention

The present invention relates generally to the field of protective respiratory masks and more particularly to a mask which is contained within and as part of a garment for protecting persons from dust, smoke, toxic gasses and any other from of airborne pollution such as car and truck exhaust, paint particles and infectious biological agents. The mask is configured to be worn as a folded over collar when not in use and to be unfold and rolled up to cover a wearer's nose and mouth and substantially all of the wearer's neck when in use as part of the protective garment.

2. Description of the Related Art

In recent times, there has been some concern for public safety with respect to the detrimental effects of prolonged exposure to pollution in the form of airborne particulates. The most common forms of airborne pollution encountered by typical individuals are automotive exhaust, smoke whether caused by uncontrolled fires or from nearby manufacturing facilities, and dust and dirt which has become entrained in the air due to the passage of cars and trucks, the operation of construction equipment and not uncommonly from engaging in recreational activities which kick up dust such as mountain biking and off-road travel in popular four-wheel drive vehicles and the like.

Though rarely encountered, concern has also arisen among the public regarding protection from biological attacks by terrorists or other criminal elements. The potential for biological attacks is believed to be primarily in the form of airborne chemicals or biological agents. Another area of increasing public concern is the threat posed by airborne infectious disease such as SARS or a potential flu pandemic.

Safety masks of various types designed to address the above concerns have long been known in the art. For example, the common painter's mask has long been used to protect painters from toxic airborne paint particles which arise during the painting process. Similarly, gardener's masks have long been in existence to protect gardeners and other outdoor workers such as field workers from airborne dirt and dust. Likewise, surgeon's masks have long been in use by doctors and their staff to protect against coming into contact with infectious airborne bacteria and viruses.

In addition to the above, other more complex mask systems have been developed. One such example is U.S. Pat. No. 6,609,516 entitled "SMOKE ESCAPE MASK," issued to Hollander et al. on Aug. 26, 2003. The Hollander device includes a breathing filter sized to cover the nose and mouth of a user and also includes a transparent eye shield, which is attached to the breathing filter as well as pressure sensitive adhesive located on the device's peripheral edges for securing the mask to the face of the user. The Hollander device is provided in a sealed package for one-time use and is meant to be stored in areas where the risk of smoke inhalation from an uncontrolled fire is high.

While the Hollander device may be effective in reducing the likelihood of smoke inhalation in the case of an emergency, it like the simpler masks mentioned above suffers from a serious drawback. Namely, such masks are not commonly worn or carried by the public, especially in public areas. The lack of use by the public of such masks can partially be attributed to the fact that many people may consider the wearing of such a mask in public socially or fashionably unacceptable. In addition, such masks are an extra accessory which must be packed when traveling to a public area. As such many people forget to pack and/or purchase such masks and therefore do not have such masks readily available during a time of need. Room for improvement remains in the art.

What is needed therefore is a mask that may be incorporated into a commonly worn garment such as a shirt. The mask should be configured so as to remain unobtrusive when not in use and yet be easily deployable when the need (for instance in the case of fire or biological attack) or desire (for example to protect from irritating dust or automobile exhaust) to protect oneself from airborne particulates arises.

SUMMARY OF THE INVENTION

The protective garment of the present invention overcomes the deficiencies of the prior art by providing a convenient, easy to use, and readily accessible integral face and neck mask. The mask may be incorporated into a shirt such as the commonly and frequently worn T-shirt. By incorporating the mask into a garment such as a T-shirt many of the disadvantages of the prior art are overcome because the mask is always available and ready for use at a moments notice. The mask is designed to be unobtrusively stored in the shirt's collar or neck area when not in use. The mask may be readily deployed by grasping a feature of the invention known as "ear loops." The ear loops allow the mask to be both easily deployed and moreover secure the mask in place by slipping over a wearer's ears. The mask contains a filter element incorporated into the fabric of the shirt. The filter element covers a wearer's mouth and nose when deployed. As will be discussed in more detail herein below, the filter element may be made from a variety of materials known in the art for filtering airborne particles or gasses. The mask further provides complete coverage of a wearer's neck, i.e. the mask includes a fully wrapped neck. Other features and advantages of the invention will become apparent from the detailed description.

DESCRIPTION OF THE PREFERRED EMBODIMENT

Figure 1:
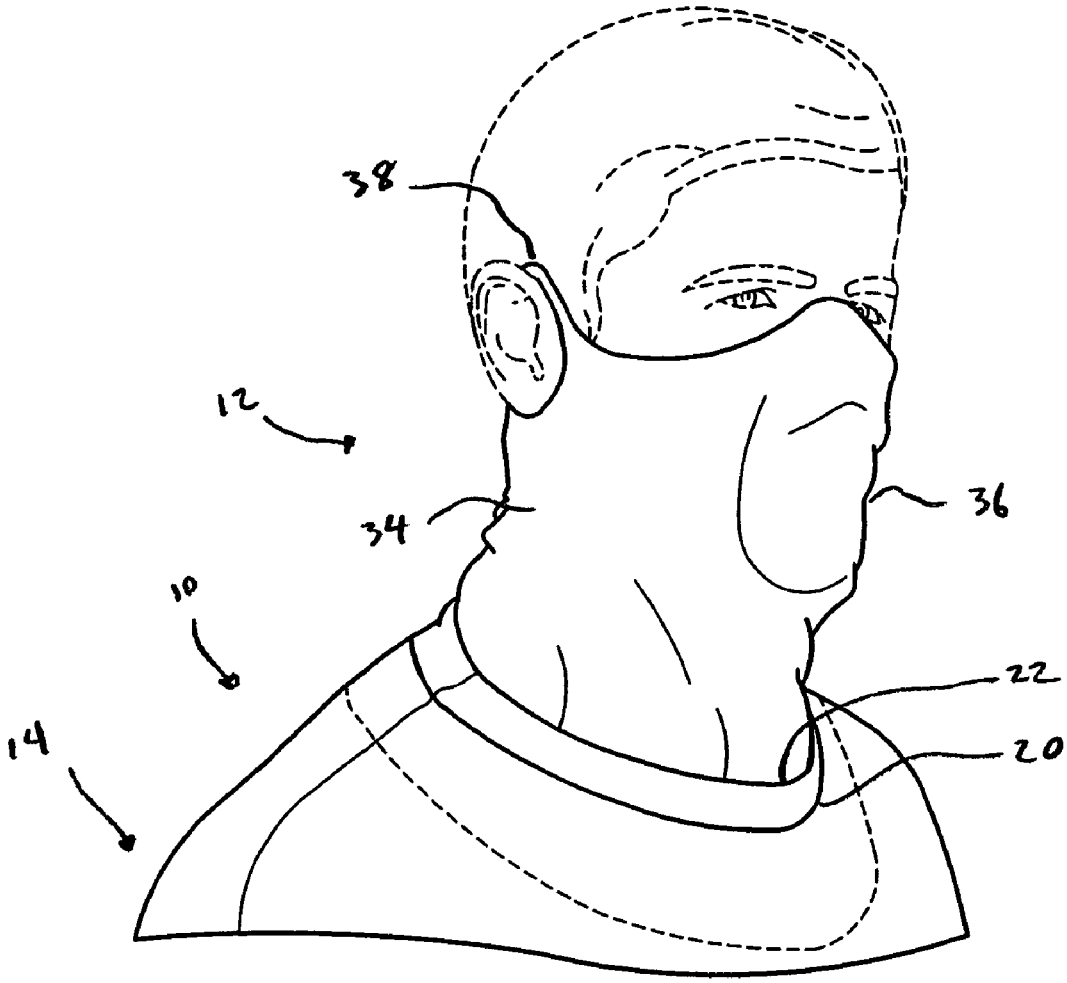
FIG. 1 is a frontally facing left side perspective view showing an embodiment of the protective mask and shirt of the present invention in a deployed position on a wearer.
Figure 2:
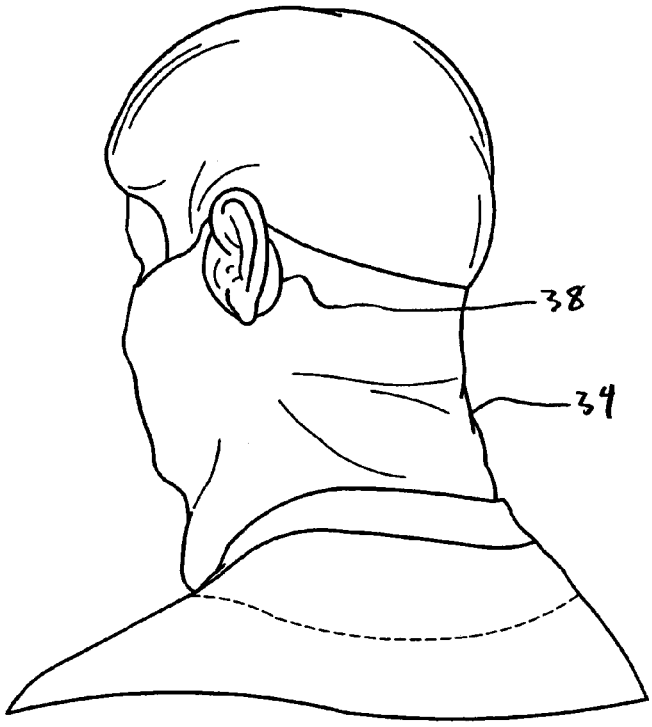
FIG. 2 is a rearwardly facing left side perspective view of the embodiment of FIG. 1 showing the protective mask and shirt of the present invention in a deployed position on a wearer.
Figure 3:
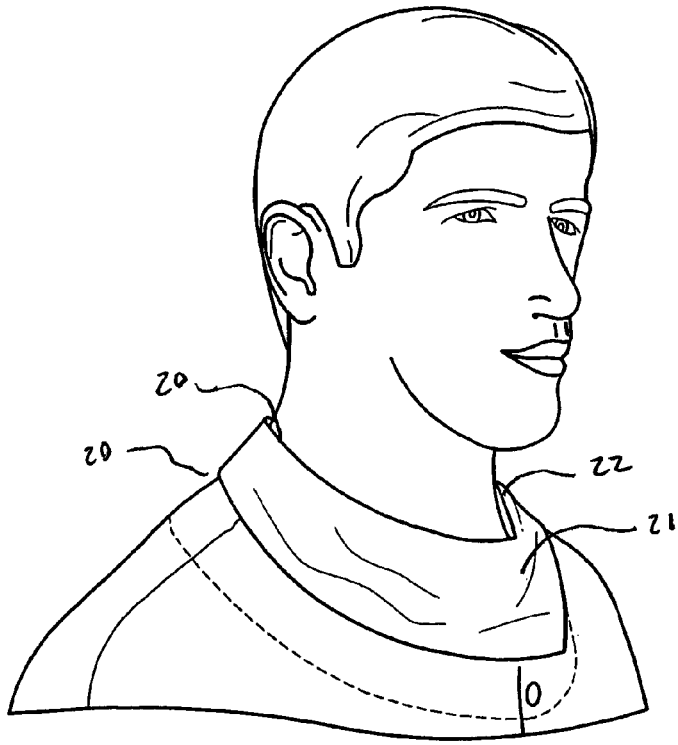
FIG. 3 is a frontally facing left side perspective view of the embodiment of FIG. 1 showing the protective mask and shirt of the present invention in a stowed position on a wearer.
Figure 4:
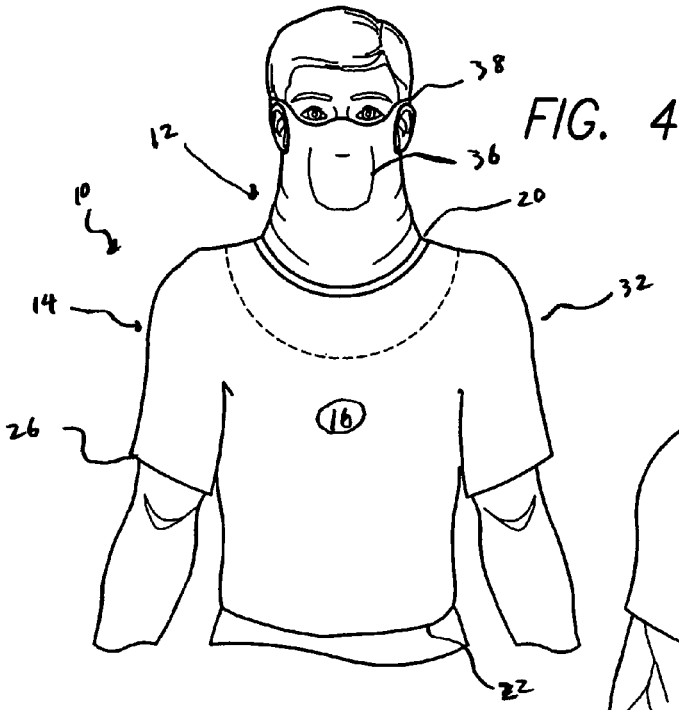
FIG. 4 is a frontally facing perspective view of the embodiment of FIG. 1 showing the protective mask and shirt of the present invention in a deployed position on a wearer.
Figure 5:
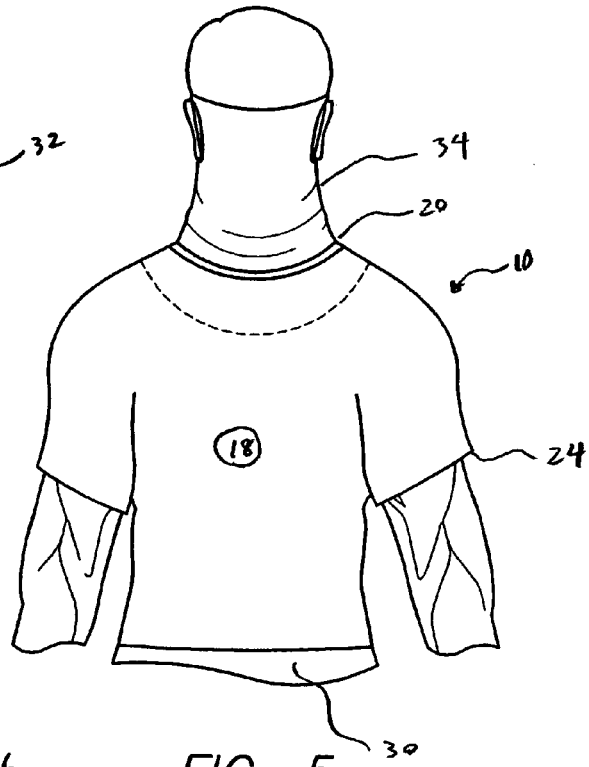
FIG. 5 is a rearwardly facing perspective view of the embodiment of FIG. 1 showing the protective mask and shirt of the present invention in a deployed position on a wearer.
Figure 6:
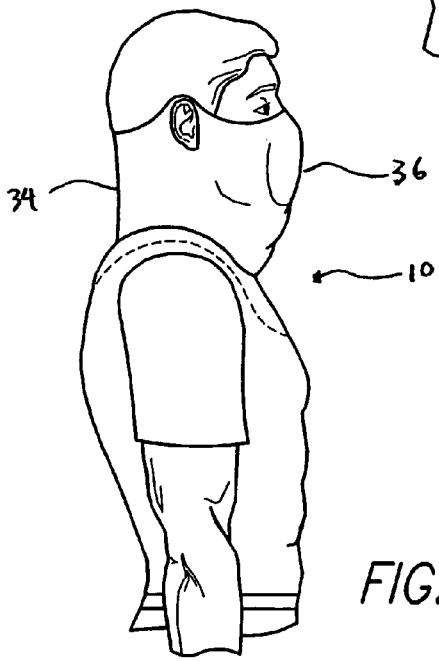
FIG. 6 is a left side view of the embodiment of FIG. 1 showing the protective mask and shirt of the present invention in a deployed position on a wearer.

Some embodiments of the present invention will be described in detail with reference to a protective garment, as generally illustrated in FIGS. 1-6. Additional embodiments, features and/or advantages of the invention will become apparent from the ensuing description or may be learned by practicing the invention. In the figures, the drawings are not to scale with like numerals referring to like features throughout both the drawings and the description. Referring now to FIGS. 1-6, and more particularly to FIGS. 4-6, there is generally illustrated a protective garment 10 which includes a mask portion 12 and a body portion 14 in accordance with the present invention. The body portion 14 includes a front panel 16 and a rear panel 18 which is attached to the front panel about peripheral edge portions 20 to form a neck opening 22 and a folded over collar 21 (FIG. 3) when mask portion 12 is in a stowed position (FIG. 3). The body portion 14 also includes arm openings 24 and 26, as well as a bottom opening 30, formed at the juncture of the peripheral edges of the front and rear panels 16, 18.

In viewing the several figures of the drawings, it is readily apparent that the front panel 16 and the rear panel 18 are sized and configured to define the body portion 14 or like upper body garment for covering the upper torso 32 of a wearer. As depicted in the figures, the body portion 14 has the appearance of a typical T-shirt. However, the scope of the invention is not intended to be limited to T-shirts. As those skilled in the art will understand, the body portion may comprise most any form of shirt or other upper body garment, including for example sweaters, jackets and coats.

With reference again to FIGS. 1-6, and more particularly to FIGS. 4-6, extending upwardly from the body portion 14 is the mask portion 12 of the invention. The mask portion includes a mask body 34 which is designed to conform to a wearer's face and neck and may be made of a single panel or multiple panels which are cut and fit to conform to typical face and neck dimensions as is known in the art of garment manufacturing. Incorporated into the mask body is a filter element 36. The filter element may be sewn into the mask body or may be attached with adhesives or in any other manner known in the art of garment manufacture. Another feature of the mask portion 12 is a pair of ear loops 38 (best seen in FIGS. 2 and 4). The ear loops may be formed integrally with the mask body 34 or may be attached via sewing or otherwise incorporated into the garment.

The filter element 36 of the present invention may be of any fabric suitable for filtering out one or more types of airborne particles, gasses, or biological agents. The filter fabric may be of a woven or non-woven material. The filter fabric may be made of natural fibers, such as cotton or wool, or may be made from synthetic fibers such polyester and polyurethane and/or other synthetic foam materials. The filter fabric can be designed to filter airborne particles and/or gasses by mechanical mechanisms (e.g. by varying the weave density and/or fabric thickness or in the case of foam materials, the foam density) and/or by chemical mechanisms (e.g. by including absorptive charcoal particles embedded in the fabric and/or foam and/or by treating the fabric and/or foam with absorptive chemicals). Filters constructed as described above are capable of filtering out many common airborne pollutants such as smoke, dust and dirt. Generally, to remove bacteria and/or viruses from the air, a filter capable of filtering particles as small as 1 to 2 microns is required. Such filters are known in the art (certain types of surgeons masks being one such example) and are suitable for use with the present invention. When equipped with such a filter, the present invention may be suitable for military applications.

When not in use, mask portion 12 of protective garment 10 may be rolled or folded down into a stowed position (FIG. 3) wherein mask portion 12 essentially forms folded over collar 21 (FIG. 3). Alternatively, mask portion 12 may be folded so as to be hidden under front and back panels 16 and 18 of protective garment 10. Other variations for stowing the mask portion are also possible. A wearer of protective garment 10 may easily deploy mask portion 12 by reaching under the shirt portion and grasping mask portion 12 by ear loops 38 (FIG. 2). Mask portion 12 may be pulled over the wearer's face and secured to the wearer's head by slipping ear loops 38 over the wearer's ears.

One of many possible examples of when a wearer may desire to deploy the mask portion 12 of the present invention garment 10 during everyday use is the situation of waiting at a bus stop. While waiting at bus stop, the wearer may be faced with a wait of several minutes wherein passing vehicles are likely to "kick-up" a substantial volume of dust and dirt into the air in addition to the pollutants created by vehicle exhaust. In such a situation, a wearer may easily choose to protect himself from such pollution by deploying the mask portion by pulling the mask portion from its stowed position via the ear loops 38. Thereafter, once the bus has arrived and the wearer has boarded, the mask portion may be easily returned to its stowed position, ready for redeployment at any time.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention protective face mask, which do not depart from the spirit and scope of the foregoing specification and drawings, and of the claims appended below, are possible and practical. It is intended that the claims cover all such modifications and alternative embodiments.

What is claimed is:

1. A protective garment comprising:

a body portion;

a mask portion extending away from said body portion and being adapted to conform to a wearer's face and neck when deployed from a stowed position in which said mask portion forms a folded over collar, said folded over collar defining a substantially rounded neck opening; and at least one filter element incorporated in said mask portion and configured to cover the wearer's mouth and nose when said mask portion is deployed, said deployed mask portion being adapted in at least one location away from said neck opening to be secured in place on the wearer's head, wherein said deployed mask portion includes at least one integral ear loop, said mask portion being deployed from said stowed position by grasping and pulling said at least one integral ear loop away from said neck opening.

2. A protective garment comprising:

a body portion including a front panel and a rear panel coupled along respective peripheral edges;

a mask portion extending away from said body portion and being adapted to conform to a wearer's face and neck when deployed from a stowed position in which said mask portion forms a folded over collar, said folded over collar defining a substantially rounded neck opening; and at least one filter element incorporated in said mask portion and configured to cover the wearer's mouth and nose when said mask portion is deployed, said deployed mask portion being adapted in at least one location away from said neck opening to be secured in place on the wearer's head.

3. The protective garment of claim 2, wherein said body portion further includes arm openings.

4. The protective garment of claim 2, wherein said body portion further includes a bottom opening formed at the juncture of said respective peripheral edges.

5. The protective garment of claim 2, wherein said front and rear panels are configured to cover the upper torso of a user.

* * * * *